US008826782B2

(12) United States Patent
Chen

(10) Patent No.: US 8,826,782 B2
(45) Date of Patent: Sep. 9, 2014

(54) ROTATABLE TOOL HANDLE

(75) Inventor: I-Su Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 242 days.

(21) Appl. No.: 13/555,176

(22) Filed: Jul. 22, 2012

(65) Prior Publication Data

US 2013/0239757 A1 Sep. 19, 2013

(30) Foreign Application Priority Data

Mar. 13, 2012 (TW) ..... 101108405 A

(51) Int. Cl.
*B25B 23/16* (2006.01)

(52) U.S. Cl.
USPC ..... 81/177.7; 81/177.4

(58) Field of Classification Search
USPC ..... 81/177.7, 177.4, 177.8, 177.9
See application file for complete search history.

(56) References Cited

U.S. PATENT DOCUMENTS

| | | | | |
|---|---|---|---|---|
| 7,328,635 | B2 * | 2/2008 | Hu | 81/177.9 |
| 7,347,127 | B2 * | 3/2008 | Hu | 81/177.9 |
| 7,434,496 | B2 * | 10/2008 | Hu | 81/177.7 |
| 7,481,135 | B2 * | 1/2009 | Schoenbeck et al. | 81/177.7 |

* cited by examiner

*Primary Examiner* — David B Thomas
(74) *Attorney, Agent, or Firm* — Banger Shia

(57) ABSTRACT

A rotatable tool handle comprises a first part and a second part which can be switched between an in-line position and an angle position. Further, the locking structure for fixing the first and second parts is disposed between the connecting structures of the first and second parts, so that the engaging points of the first and second parts lie on the rotation axis of the two parts. Moreover, the portion of the first part for forming the recess is harder than the rest of the first part, and the portion of the second part for forming the pivot portion is harder than the rest of the second part, so as to enhance the structural strength of the engaging structure of the first and second parts of the handle.

12 Claims, 14 Drawing Sheets

ROTATABLE TOOL HANDLE

BACKGROUND OF THE INVENTION

1. Field of the Invention

The present invention relates to a tool handle, and more particularly to a rotatable tool handle which is capable of being switched between an in-line position and an angle position.

2. Description of the Prior Art

A conventional rotatable screwdriver handle 10 as shown in FIGS. 1A, 1B and 2 comprises an upper part 11 and a lower part 12, which are each provided with a slanted end surface 111, 121. The end surface 121 of the lower part 12 is formed with an axial protrusion 122 to be inserted in a concave 112 of the end surface 111 of the upper part 11. In the concave 112 is further formed a recess 113, and in the recess 113 is defined an assembling hole 114 which penetrates through the circumferential surface of the upper part 11. A pin 13 is inserted through the recess 113 and into the assembling hole 114. The axial protrusion 122 of the lower part 12 is formed with two cavities 123, and in each of the cavities 123 is disposed a spring 14 and an engaging member 15. Pressing the pin 13 can make the engaging member 15 disengage from the recess 113 of the upper part 11 of the handle 10, which allows the upper and lower parts 11, 12 of the handle 10 to be switchable to an in-line state or an angled state. When the pin 13 is released from being pressed, one of the engaging members 15 will be pushed by the spring 14 into the recess 113 of the upper part 11, so that the upper and lower parts 11, 12 of the handle 10 are fixed relative to each other. This screwdriver handle 10 is structurally complicated and not easy to assemble.

FIG. 3 shows another rotatable handle 10, wherein the slanted end surface 121 of the lower part 12 is formed both sides of the axial protrusion 122 with two cavities 124, and the spring 14 and an engaging member 15 are provided on the upper part 11. Pressing or releasing a control member 16 can make the engaging member 15 slide back into the upper part 11 of the handle 10 or extend into the cavities 124 of the lower part 12, so as to make the upper and lower parts 11, 12 switchable or fixed with respect to each other.

It is to be noted that the handle 10 has only a single engaging member 15 engaged in the cavities 124 to fix the upper and lower parts of the handle, and the cavities 124 are formed on the lower part 12 with an inferior rigidity, the engagement structure between the engaging member 15 and the cavities 124 has a relatively weak structural strength, namely, the engaging member 15 and the cavities 124 are likely to be broken when a force applied to rotate the handle 10 is relatively large.

The present invention has arisen to mitigate and/or obviate the afore-described disadvantages.

SUMMARY OF THE INVENTION

The primary object of the present invention is to provide a rotatable tool handle, wherein the handle comprises a first part and a second part which can be switched between an in-line position and an angle position. Further, the locking structure for fixing the first and second part is disposed between the connecting structures of the first and second parts, so that the engaging points of the first and second parts lie on the rotation axis of the two parts. Moreover, the portion of the first part for forming the recess is harder than the rest of the first part, and the portion of the second part for forming the pivot portion is harder than the rest of the second part, so as to enhance the structural strength of the engaging structure of the first and second parts of the handle.

To achieve the above object, a rotatable tool handle comprises a first part and a second part. The first part is formed with a first slanted end surface at one end thereof, the first slanted end surface is formed at a center thereof with a recess, and a first engaging cavity is formed at a bottom of the recess. The second part is formed with a second slanted end surface at one end for mating with the first slanted end surface, the second slanted end surface is formed with a pivot portion to be inserted in the recess of the first part. At an end surface of the pivot portion is a second engaging cavity formed in the shape of the first engaging cavity, on a peripheral surface of the second part is defined an assembling cavity, and a penetrating hole is formed at a bottom of the second engaging cavity and extending to the assembling cavity. The first and second engaging cavities each have at least two pairs of opposite ends. A control member is movably disposed in the assembling cavity of the second part. A pin includes an operating end to be inserted in the penetrating hole of the second part and pushed against by the control member, and a drive end to be inserted in the second engaging cavity. An engaging member is formed in the shape of the first and second engaging cavities and engaged in the first engaging cavity, the engaging member is aligned with and capable of engaging with the second engaging cavity after the second part rotates 180 degrees. An elastic member is disposed between the engaging member and the first engaging cavity in such a manner that the engaging member is pushed against the drive end of the pin by the elastic member, and the pin is pushed by the control member to selectively keep the engaging member between the first and second engaging cavities or to push the engaging member back into the first engaging cavity.

DETAILED DESCRIPTION OF THE PREFERRED EMBODIMENTS

Figure 1A:
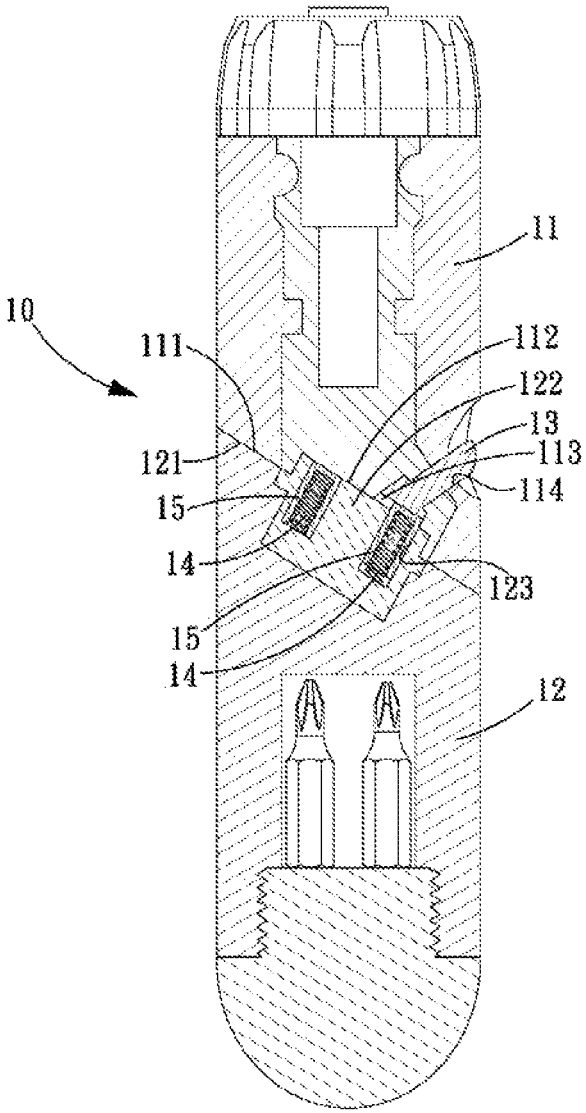
FIG. 1A PRIOR ART
FIG. 1A is a cross sectional view of a conventional screwdriver handle.
Figure 1B:
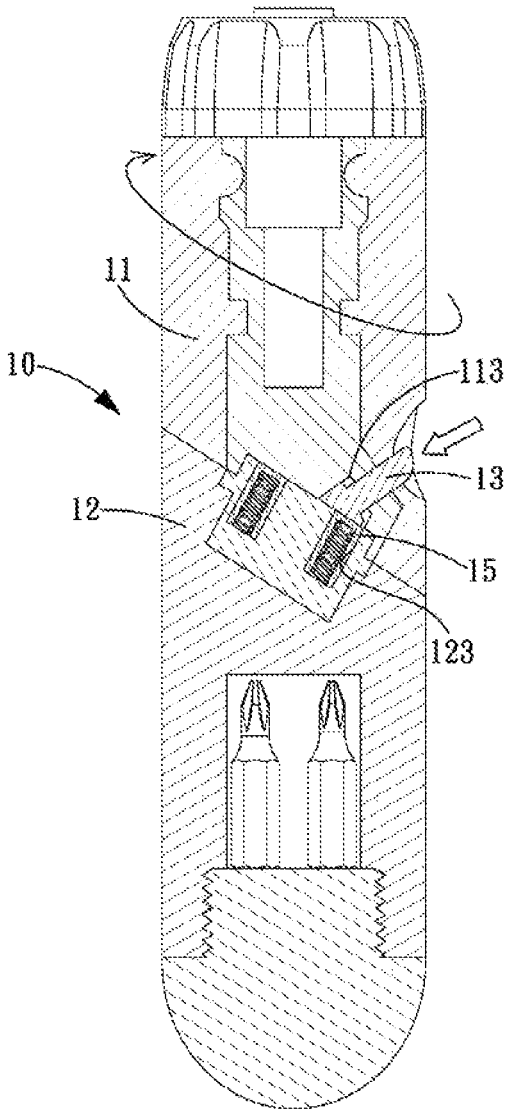
FIG. 1B PRIOR ART
FIG. 1B is an operational view of the screwdriver handle of FIG. 1A.
Figure 2:
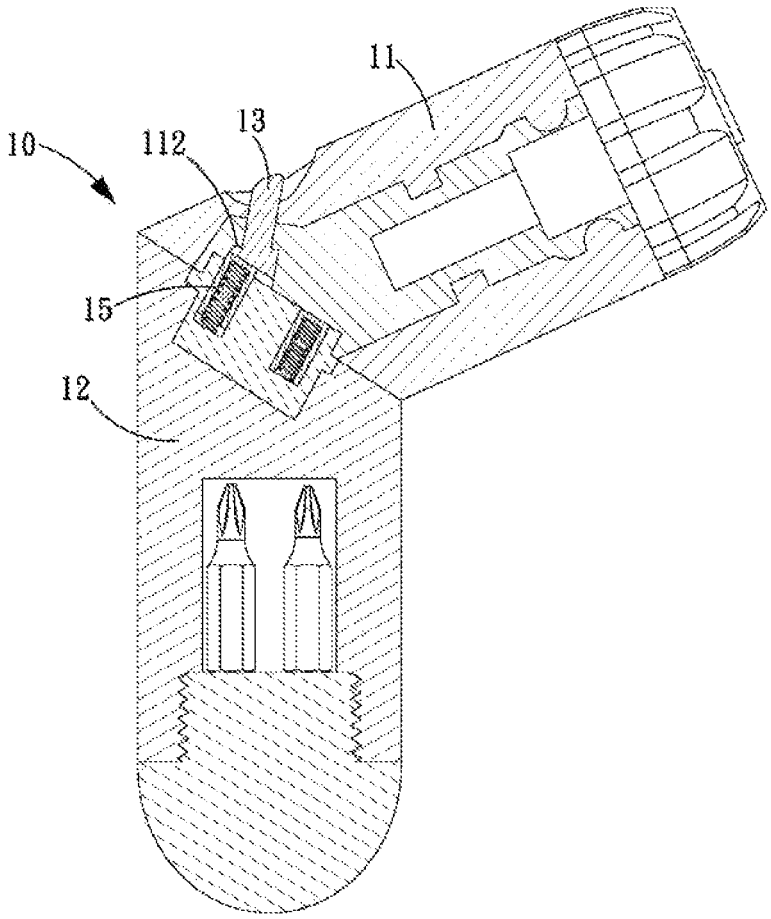
FIG. 2 PRIOR ART
FIG. 2 shows that the conventional screwdriver handle is switched to an angled position.
Figure 3:
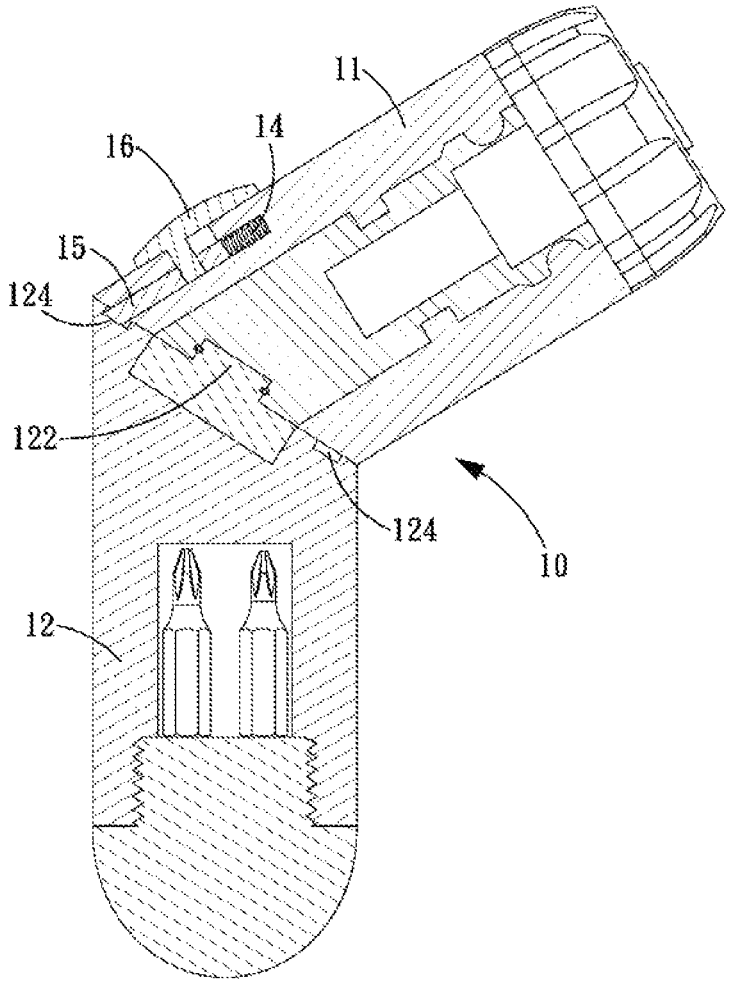
FIG. 3 PRIOR ART
FIG. 3 shows another conventional screwdriver handle.
Figure 4:
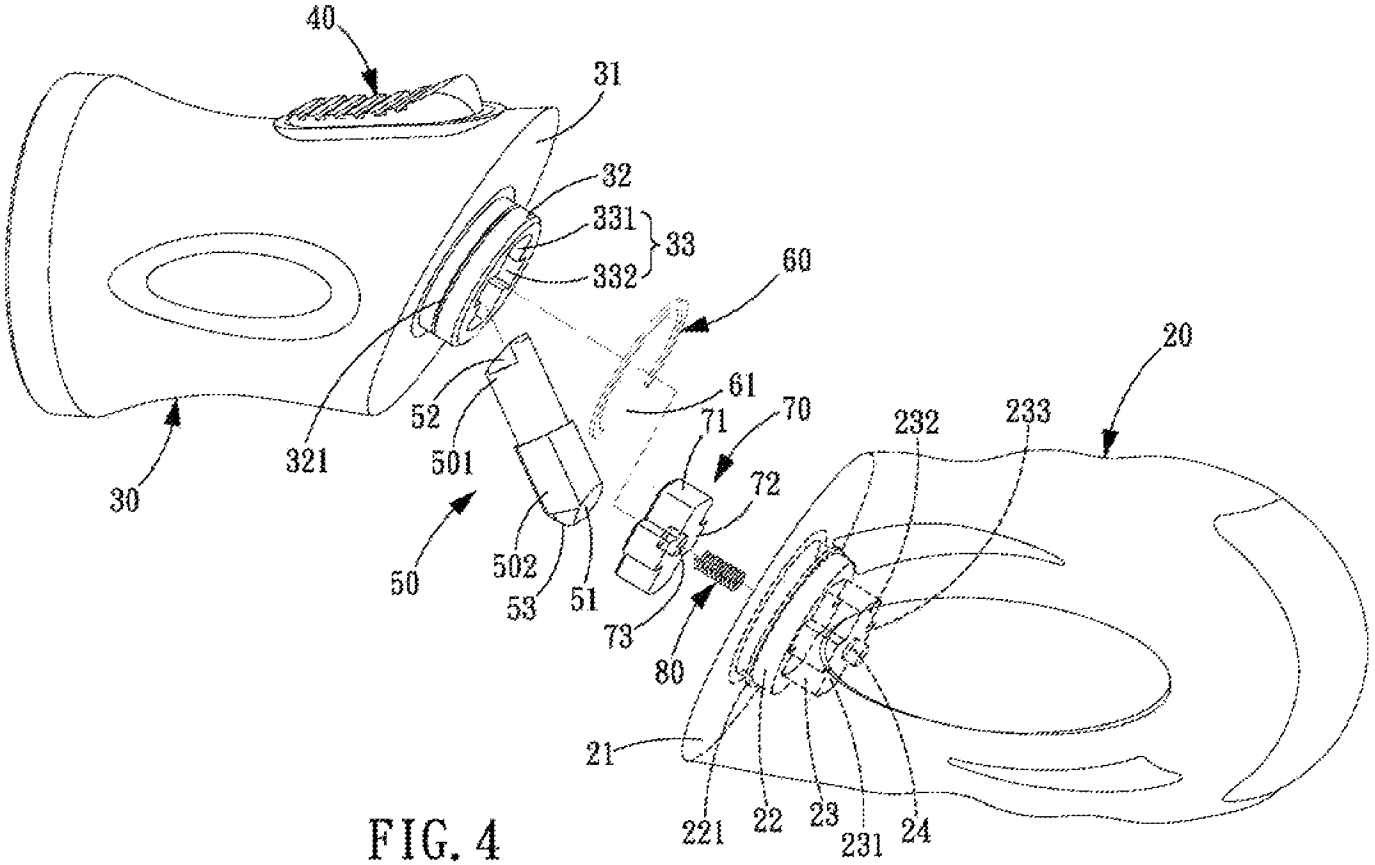
FIG. 4 is an exploded view of a rotatable tool handle in accordance with a first embodiment of the present invention.
Figure 5:
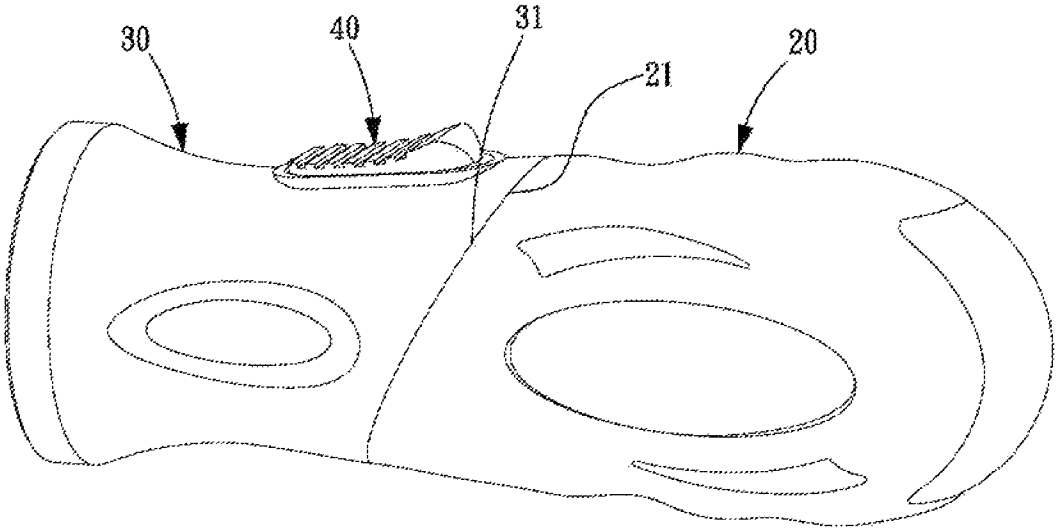
FIG. 5 is an assembly view of the rotatable tool handle in accordance with the first embodiment of the present invention.

The present invention will be clearer from the following description when viewed together with the accompanying drawings, which show, for purpose of illustrations only, the preferred embodiment in accordance with the present invention.

Referring to FIGS. 4, 5, 6A, 7A and 8A, a rotatable tool handle in accordance with a first embodiment of the present invention is shown, wherein the rotatable tool handle comprises a first part 20 and a second part 30. The positioning device is disposed between the first and second parts 20, 30 of the tool handle and comprises a control member 40, a pin 50, a positioning member 60, an engaging member 70 and an elastic member 80.

The first part 20 is formed with a first slanted end surface 21 at one end thereof and a chamber 25 at another end thereof. The chamber 25 is sealed with a cover 26. The first slanted end surface 21 is formed at the center thereof with a recess 22, an annular groove 221 is formed around the inner surface of the recess 22, a first engaging cavity 23 is formed at a bottom of the recess 22, and a receiving cavity 24 is formed at a bottom surface 231 of the first engaging cavity 23. The first engaging cavity 23 is formed with at least two pairs of opposite ends. In this embodiment, the first engaging cavity 23 is cross-shaped and has two opposite first ends 232 and two opposite second ends 233, and the first ends 232 are wider than the second ends 233. The first engaging cavity 23 can also be square-shaped or rectangular-shaped. The inner surface of the recess 22 and the first engaging cavity 23 are perpendicular to the first slanted end surface 21, and the bottom surface 231 of the first engaging cavity 23 is parallel to the first slanted end surface 21.

The second part 30 is formed with a second slanted end surface 31 at one end for mating with the first slanted end surface 21, and an assembling hole 36 at another thereof for assembling a work piece. The second slanted end surface 31 is formed with a pivot portion 32 to be inserted in the recess 22 of the first part 20. Around the circumferential surface of the pivot portion 32 is formed an annular groove 321 to be aligned with the annular groove 221 of the first part 20, and at an end surface of the pivot portion 32 is formed a second engaging cavity 33 formed in the shape of the first engaging cavity 23. On the peripheral surface of the second part 30 is defined an assembling cavity 34, and a penetrating hole 35 is formed at the bottom of the second engaging cavity 33 and extends to the assembling cavity 34.

In this embodiment, the peripheral surface of the pivot portion 32 of the second part 30 and the inner surface of the second engaging cavity 33 are perpendicular to the second slanted end surface 31. The second engaging cavity 33 is cross-shaped and has two opposite first ends 331 and two opposite second ends 332, and the first ends 331 are wider than the second ends 332.

The control member 40 is movably disposed in the assembling cavity 34 of the second part 30, and inside the control member 40 is formed with a push portion 41.

Figure 6A:
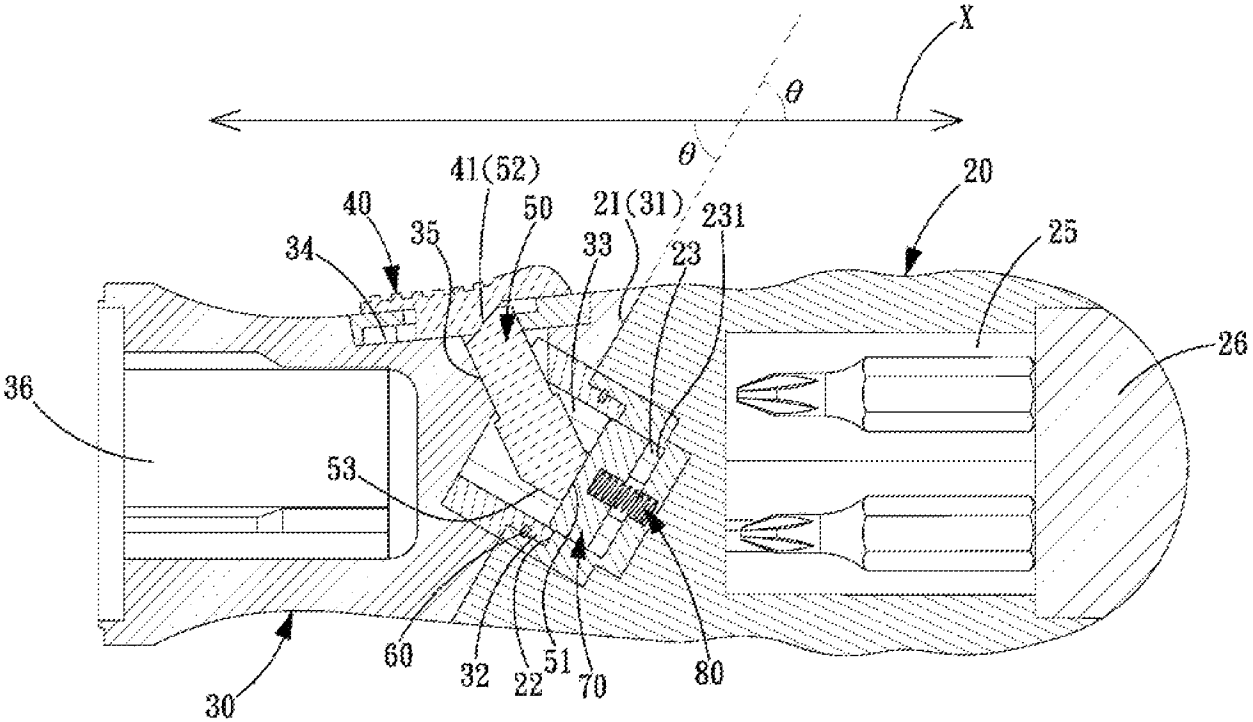
FIG. 6A is a cross sectional view of the rotatable tool handle in accordance with the first embodiment of the present invention.

The pin 50 includes an operating end 501 to be inserted in the penetrating hole 35 of the second part 30 and pushed against by the control member 40, and a drive end 502 to be inserted in the second engaging cavity 33. In this embodiment, as shown in FIG. 6A, the pin 50 is provided with a slide surface 52 at the operating end 501 and a push surface 51 at the drive end 502. The slide surface 52 and the push surface 51 are parallel to the second slanted end surface 31 of the second part 30, the slide surface 52 is pushed against the push portion 41 of the control member 40, and the push surface 51 is pushed against the engaging member 70. The drive end 502 of the pin 50 is further provided with an abutting surface 53 which is perpendicular to the push surface 51 and located toward the inner surface of the second engaging cavity 33, and the abutting surface 53 is designed to reduce friction between the pin 50 and the inner surface of the second engaging cavity 33.

The positioning member 60 in this embodiment is a C-ring formed with a notch 61 and disposed between the annular grooves 221, 321 of the pivot portion 32 of the second part 30 and the first part 20 to pivotally connect the first and second parts 20, 30 of the handle.

The engaging member 70 is cross-shaped, formed in the shape of the first and second engaging cavities 23, 33 and includes two opposite first ends 71 and two opposite second ends 72 which are wider than the two first ends 71. The engaging member 70 has the two first ends 71 engaged in the first ends 232 of the first engaging cavity 23 and has the second ends 72 engaged in the second ends 233 of the first engaging cavity 23. The engaging member 70 is further formed with a receiving cavity 73 to be aligned with the receiving cavity 24 of the first part 20.

The elastic member 80 is disposed between the receiving cavity 73 of the engaging member 70 and the receiving cavity 24 of the first part 20 in such a manner that the engaging member 70 is pushed against the drive end 502 of the pin 50 by the elastic member 80, and the pin 50 is pushed by the control member 40 to selectively keep the engaging member 70 between the first and second engaging cavities 23, 33 or to push the engaging member 70 back into the first engaging cavity 23.

The portion of the first part 20 for forming the recess 22 is harder than the rest of the first part 20, and the portion of the second part 30 for forming the pivot portion 32 is harder than the rest of the second part 30.

What mentioned above are the structural relations of the main components of the present invention, for a better understanding of its operation and function, reference should be made to FIGS. 6A-8B.

Figure 6B:
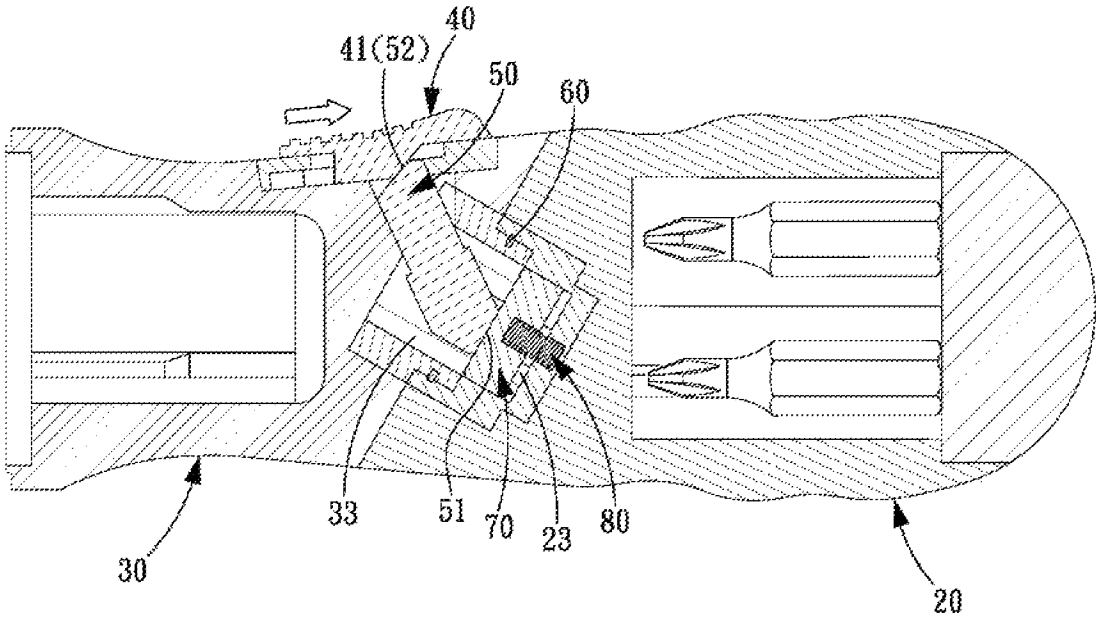
FIG. 6B is an operational view of FIG. 6A.

As shown in FIG. 6A, the first and second parts 20, 30 of the handle are maintained in an in-line state, and the first and second slanted end surfaces 21, 31 define an angle θ, which is preferably 45 degrees, with respect to an axial direction X of the first and second parts 20, 30. In normal conditions (when the control member 40 is not being pushed), the elastic member 80 pushes the engaging member 70 to a position between the first and second engaging cavities 23, 33, meanwhile, the pin 50 is pushed toward the control member 40, and the push surface 51 of the pin 50 is abutted against the center of the engaging member 70. When the control member 40 is pushed to make the push surface 51 of the pin 50 slide against the engaging member 70, the engaging member 70 will be pushed into the first engaging cavity 23 in such a manner that the top surface of the engaging member 70 is flush with the first slanted end surface 21, and the push surface 51 of the pin 50 is flush with the second slanted end surface 31, as shown in FIG. 6B, so that the first and second parts 20, 30 are switchable with respect to each other.

Figure 7A:
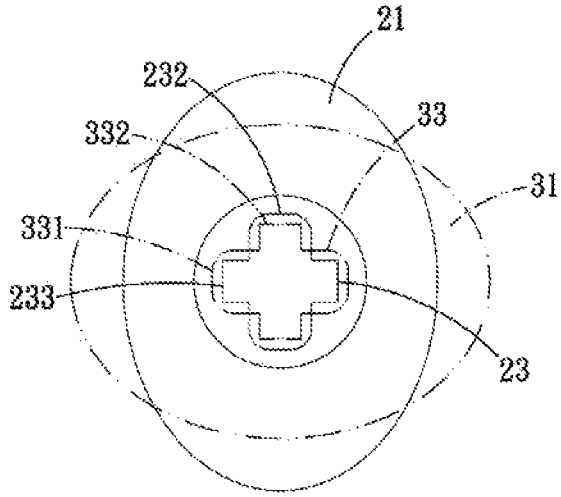
FIG. 7A is a cross sectional view showing that the tool handle of the present invention is switched 90 degrees to an angled position.
Figure 7B:
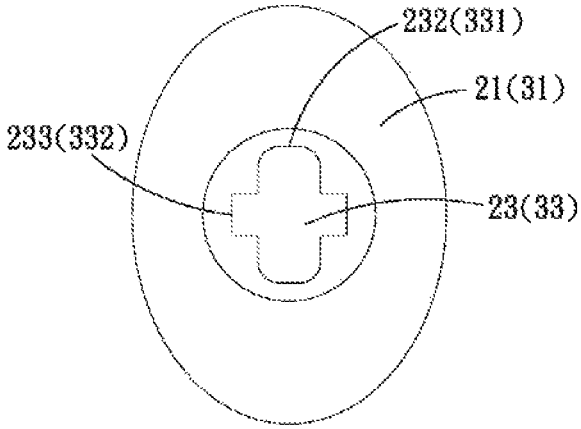
FIG. 7B is a cross sectional view showing that the tool handle of the present invention is switched 180 degrees to an in-line position.
Figure 8A:
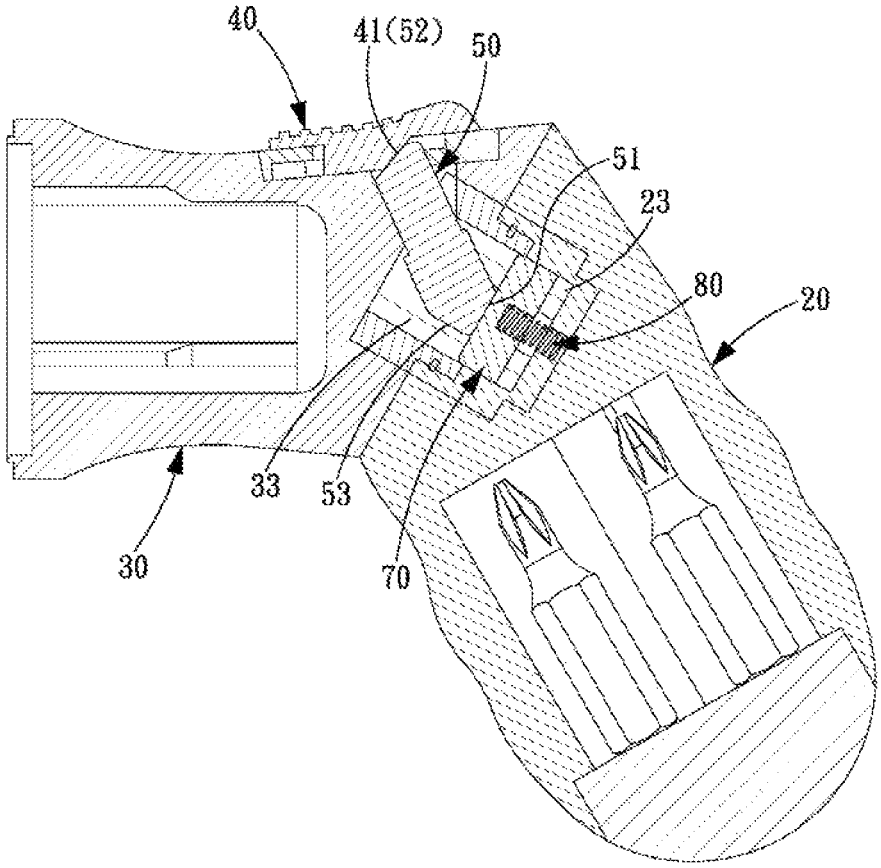
FIG. 8A is a cross sectional view of the present invention showing that the tool handle is locked in an angled position.
Figure 8B:
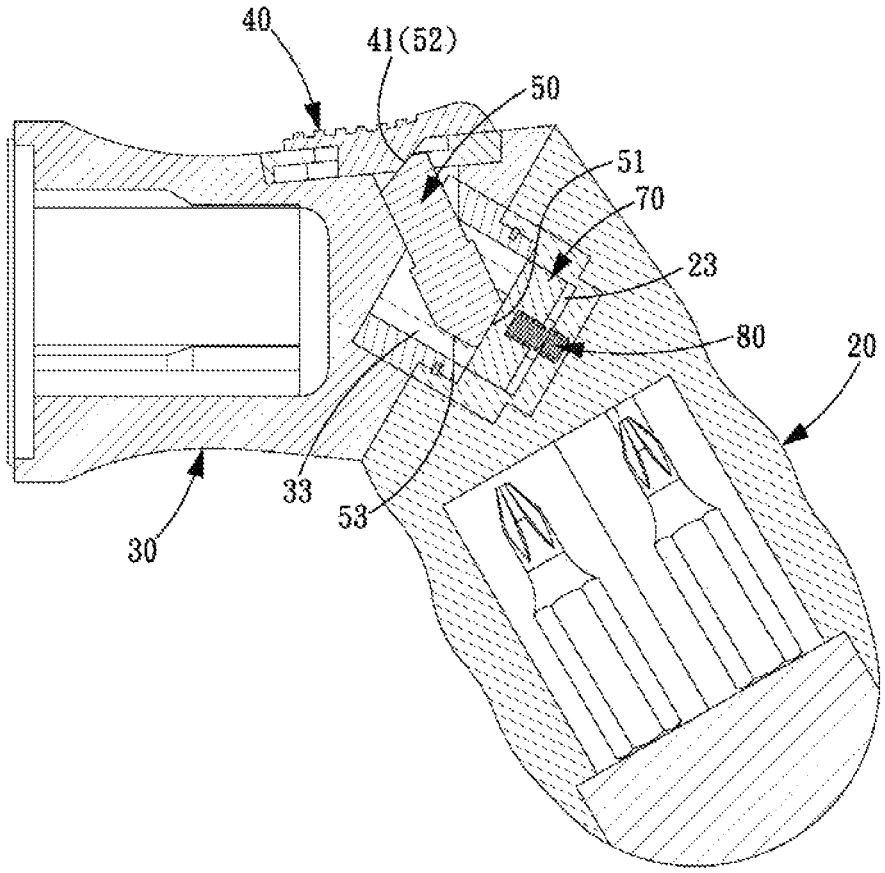
FIG. 8B is a cross sectional view of the present invention showing that the tool handle is in an angled position, and the first and second parts are not locked with each other.

FIG. 7A shows that after the second part 30 is switched 90 degrees with respect to the first part 20 to an angled position, the first and second slanted end surfaces 21, 31 will be misaligned with each other, and so will be the first and second engaging cavities 23, 33 in such a manner the first ends 232 of the first engaging cavity 23 are aligned with the second ends 332 of the second engaging cavity 33, while the second ends 233 of the first engaging cavity 23 are aligned with the first ends 331 of the second engaging cavity 33, thus preventing the engaging member 70 from moving into the second engaging cavity 33. FIG. 7B shows that after the second part 30 is switched 180 degrees with respect to the first part 20 to an in-line position, the first and second slanted end surfaces 21, 31 will be aligned with each other, and so will be the first and second engaging cavities 23, 33 in such a manner the first ends 232 of the first engaging cavity 23 are aligned with the first ends 331 of the second engaging cavity 33, while the second ends 233 of the first engaging cavity 23 are aligned with the second ends 332 of the second engaging cavity 33, so that the engaging member 70 can be pushed into the second engaging cavity 33, and thus the first and second parts 20, 30 are fixed from rotating with respect to each other, as shown in FIG. 8A. Referring then to FIG. 8B, just pushing the control member 40 can allow the first and second parts 20, 30 to be switched to the in-line position from the angled position.

Figure 9A:
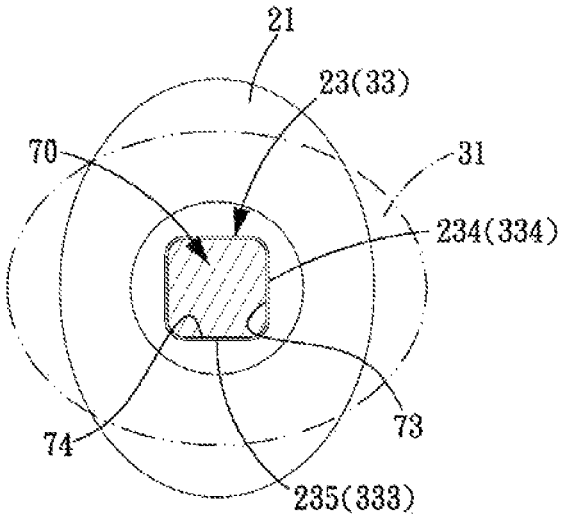
FIG. 9A is an axial cross sectional view showing that the tool handle of another embodiment of the present invention is switched 90 degrees to an angled position.
Figure 9B:
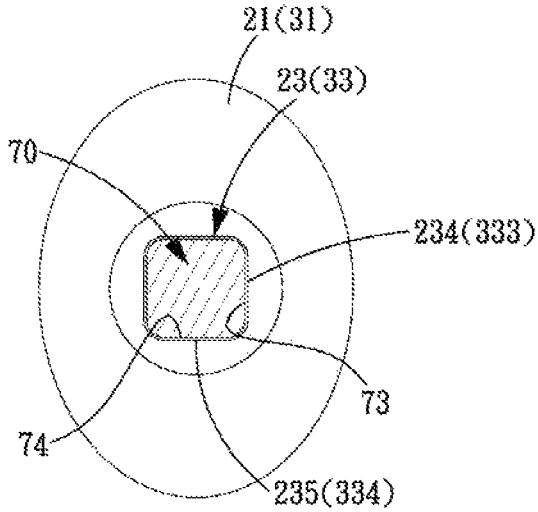
FIG. 9B is an axial cross sectional view showing that the tool handle of another embodiment of the present invention is switched 180 degrees to an in-line position.

It is to be noted that, as shown in FIGS. 9A and 9B, the first and second engaging cavities 23, 33 can also be a square-shaped cavity with two opposite first edges 234, 333 and two opposite second edges 235, 334. The engaging member 70 is also a square-shaped structure with two opposite first edges 73 and two opposite second edges 74 for abutting against the opposite first edges 234, 333 and the two opposite second edges 235, 334 of the first and second engaging cavities 23, 33. As shown FIG. 9A, after the second part 30 is switched 90 degrees with respect to the first part 20 to an angled position, the first and second edges 234, 235 of the first engaging cavity 23 are aligned with the second and first edges 334, 333 of the second engaging cavity 33, respectively. When the second part 30 is switched 180 degrees with respect to the first part 20 to an in-line position, as shown in FIG. 9B, the first and second edges 234, 235 of the first engaging cavity 23 are aligned with the first and second edges 333, 334 of the second engaging cavity 33, respectively. The first and second engaging cavities 23, 33 can also be hexagonal, octagonal, and etc as along as it has an even number of edges.

Figure 10A:
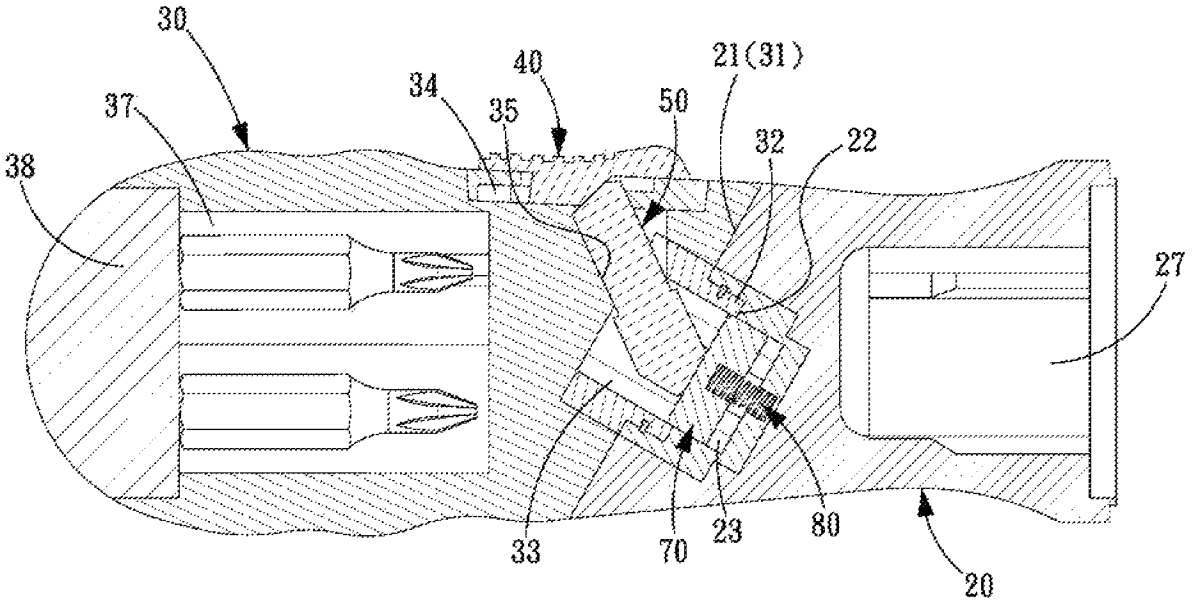
FIG. 10A is a longitudinal cross sectional view showing that the tool handle of another embodiment of the present invention is switched 90 degrees to an angled position.
Figure 10B:
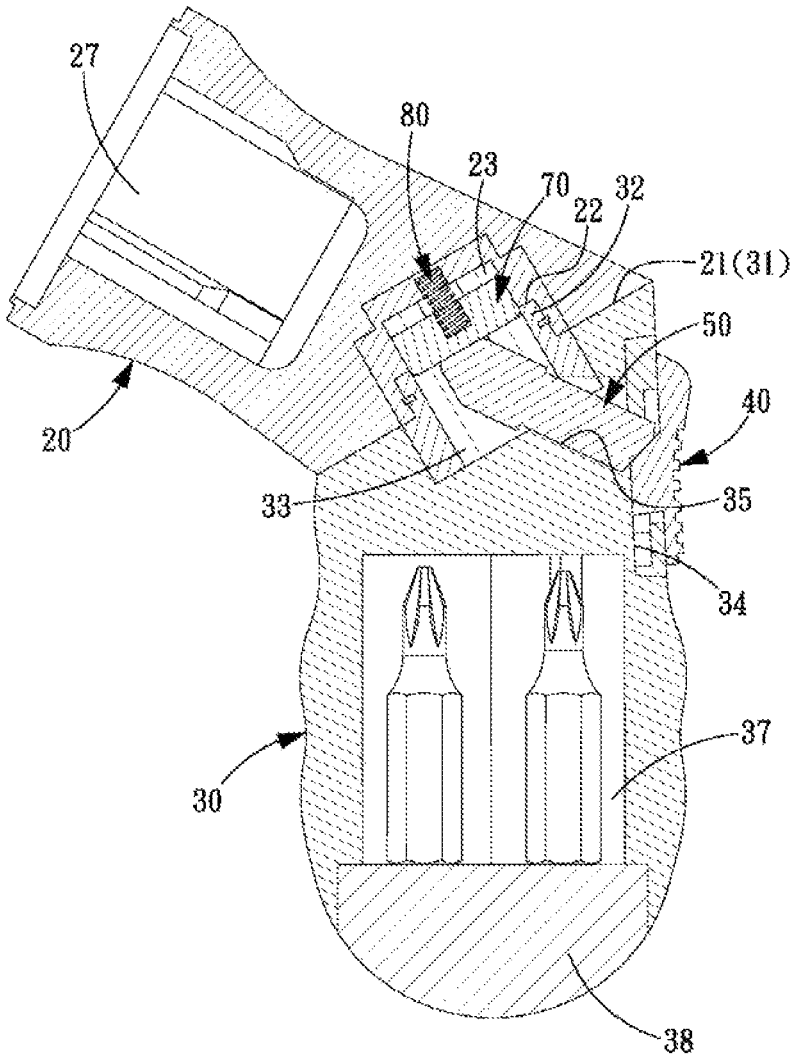
FIG. 10B is a longitudinal cross sectional view showing that the tool handle of another embodiment of the present invention is switched 180 degrees to an in-line position.

Referring then to FIGS. 10A and 10B, another embodiment of the present invention is shown and similar to the first embodiment except that: another end of the first part 20 opposite the first slanted end surface 21 is formed with an assembling cavity 27 for engaging with a work piece, and another end of the second part 30 opposite the second slanted end surface 31 is formed with a chamber 37 for reception of tool heads, and the chamber 37 is sealed with a cover 38.

While we have shown and described various embodiments in accordance with the present invention, it is clear to those skilled in the art that further embodiments may be made without departing from the scope of the present invention.

What is claimed is:

1. A rotatable tool handle comprising:

a first part formed with a first slanted end surface at one end thereof, the first slanted end surface being formed at a center thereof with a recess, a first engaging cavity being formed at a bottom of the recess;

a second part formed with a second slanted end surface at one end for mating with the first slanted end surface, the second slanted end surface being formed with a pivot portion to be inserted in the recess of the first part, at an end surface of the pivot portion being formed a second engaging cavity formed in the shape of the first engaging cavity, on a peripheral surface of the second part being defined an assembling cavity, and a penetrating hole being formed at a bottom of the second engaging cavity and extending to the assembling cavity, the first and second engaging cavities each including at least two pairs of opposite ends;

a control member movably disposed in the assembling cavity of the second part;

a pin including an operating end to be inserted in the penetrating hole of the second part and pushed against by the control member, and a drive end to be inserted in the second engaging cavity;

an engaging member formed in the shape of the first and second engaging cavities and engaged in the first engaging cavity, the engaging member being aligned with and capable of engaging with the second engaging cavity after the second part rotates 180 degrees;

an elastic member disposed between the engaging member and the first engaging cavity in such a manner that the engaging member is pushed against the drive end of the pin by the elastic member, and the pin is pushed by the control member to selectively keep the engaging member between the first and second engaging cavities or to push the engaging member back into the first engaging cavity.

2. The rotatable tool handle as claimed in claim 1, wherein the first and second parts are in an in-line state, and the first and second slanted end surfaces define an angle of 45 degrees with respect to an axial direction of the first and second parts.

3. The rotatable tool handle as claimed in claim 1, wherein an inner surface of the recess and the first engaging cavity are perpendicular to the first slanted ends surface, a bottom surface of the first engaging cavity is parallel to the first slanted end surface, and a peripheral surface of the pivot portion of the second part and an inner surface of the second engaging cavity are perpendicular to the second slanted surface.

4. The rotatable tool handle as claimed in claim 1, wherein the pin is provided with a slide surface at the operating end and a push surface at the drive end, the slide surface and the push surface are parallel to the second slanted surface of the second part, the slide surface is pushed against a push portion of the control member, and the push surface is pushed against the engaging member.

5. The rotatable tool handle as claimed in claim 1, wherein the drive end of the pin is further provided with a push surface which is parallel to the second slanted surface of the second part, and further provided with an abutting surface which is located toward the inner surface of the second engaging cavity.

6. The rotatable tool handle as claimed in claim 1, wherein an annular groove is formed around an inner surface of the recess, around a circumferential surface of the pivot portion is formed an annular groove to be aligned with the annular groove of the first part, and a positioning member which is a C-ring is disposed between the annular grooves of the pivot portion of the second part and the first part to pivotally connect the first and second parts.

7. The rotatable tool handle as claimed in claim 1, wherein a receiving cavity is formed at a bottom surface of the first engaging cavity, the engaging member is formed with a receiving cavity to be aligned with the receiving cavity of the first part, and the elastic member is disposed between the receiving cavity of the engaging member and the receiving cavity of the first part.

8. The rotatable tool handle as claimed in claim 1, wherein the first and second engaging cavities and the engaging member are cross-shaped and each have two opposite first ends and two opposite second ends, and the first ends are wider than the second ends.

9. The rotatable tool handle as claimed in claim 1, wherein the first part is formed with a chamber at another end thereof for reception of tool heads, and the chamber is sealed with a cover, and the second part is formed at another end thereof with an assembling cavity for engaging with a work piece.

10. The rotatable tool handle as claimed in claim 1, wherein the first part is formed at another end thereof with an assembling cavity for engaging with a work piece, and the chamber is sealed with a cover, and the second part is formed with a chamber at another end thereof for reception of tool heads.

11. The rotatable tool handle as claimed in claim 1, wherein the first and second engaging cavities are square-shaped cavities with two opposite first edges and two opposite second edges, the engaging member is also a square-shaped structure with two opposite first edges and two opposite second edges for abutting against the opposite first edges and the two opposite second edges of the first and second engaging cavities.

12. A rotatable tool handle comprising:

a first part formed with a first slanted end surface at one end thereof, the first slanted end surface is formed at a center thereof with a recess, an annular groove being formed around an inner surface of the recess, a first engaging cavity being formed at a bottom of the recess, a receiving cavity being formed at a bottom surface of the first engaging cavity;

a second part formed with a second slanted end surface at one end for mating with the first slanted end surface, the second slanted end surface being formed with a pivot portion to be inserted in the recess of the first part, around a circumferential surface of the pivot portion being formed an annular groove to be aligned with the annular groove of the first part, at an end surface of the pivot portion being formed a second engaging cavity formed in the shape of the first engaging cavity, on a peripheral surface of the second part being defined an assembling cavity, and a penetrating hole being formed at a bottom of the second engaging cavity and extending to the assembling cavity, the first and second engaging cavities being cross-shaped and each having two opposite first ends and two opposite second ends, and the first ends being wider than the second ends;

a control member movably disposed in the assembling cavity of the second part;

a pin including an operating end to be inserted in the penetrating hole of the second part and pushed against by the control member, and a drive end to be inserted in the second engaging cavity;

a positioning member disposed between the annular grooves of the pivot portion of the second part and the first part to pivotally connect the first and second parts;

an engaging member engaged in the first engaging cavity and being cross-shaped and each having two opposite first ends and two opposite second ends, and the first ends being wider than the second ends, the engaging member being formed with a receiving cavity to be aligned with the receiving cavity of the first part;

an elastic member disposed between the engaging member and the receiving cavity of the first part in such a manner that the engaging member is pushed against the drive end of the pin by the elastic member and the pin is pushed by the control member to selectively keep the engaging member between the first and second engaging cavities or to push the engaging member back into the first engaging cavity.

* * * * *